US009134661B2

(12) United States Patent
Kitahara

(10) Patent No.: US 9,134,661 B2
(45) Date of Patent: Sep. 15, 2015

(54) IMAGE FORMING APPARATUS

(71) Applicant: Yoichi Kitahara, Kanagawa (JP)

(72) Inventor: Yoichi Kitahara, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/173,862

(22) Filed: Feb. 6, 2014

(65) Prior Publication Data

US 2014/0227000 A1 Aug. 14, 2014

(30) Foreign Application Priority Data

Feb. 14, 2013 (JP) ..... 2013-026446
Dec. 24, 2013 (JP) ..... 2013-265732

(51) Int. Cl.
*G03G 15/20* (2006.01)

(52) U.S. Cl.
CPC ..... *G03G 15/2039* (2013.01)

(58) Field of Classification Search
CPC ..... G03G 15/2039; G03G 15/2042; G03G 15/2078; G03G 15/2082
USPC ..... 399/69
See application file for complete search history.

(56) References Cited

U.S. PATENT DOCUMENTS

2008/0260406 A1 * 10/2008 Sone et al. ..... 399/69

FOREIGN PATENT DOCUMENTS

| | | | |
|---|---|---|---|
| JP | 2003-042849 | | 2/2003 |
| JP | 2006235478 A | * | 9/2006 |
| JP | 2009-098361 | | 5/2009 |

* cited by examiner

*Primary Examiner* — Erika J Villaluna
(74) *Attorney, Agent, or Firm* — Harness, Dickey & Pierce, P.L.C.

(57) ABSTRACT

An image forming apparatus includes a heating element group including a plurality of heating elements arranged in a main scanning direction; a first temperature sensor and a second temperature sensor that detect a temperature of a heating element of the plurality of heating elements; and a correction unit that corrects an output value from the first temperature sensor based on the output value from the first temperature sensor and a distance between the first temperature sensor and the heating element and corrects an output value from the second temperature sensor based on the output value from the second temperature sensor and a distance between the second temperature sensor and the heating element.

8 Claims, 9 Drawing Sheets

IMAGE FORMING APPARATUS

BACKGROUND OF THE INVENTION

1. Field of the Invention

The disclosures herein generally relate to an image forming apparatus, and especially relate to an image forming apparatus including a fixing device with plural heating elements arranged in a main scanning direction.

2. Description of the Related Art

Some electrophotographic image forming apparatuses include a fixing device, which selectively heats an image region, based on image information. In such an electrophotographic image forming apparatus, two thermopile arrays, which are arranged obliquely, detect a temperature of a detection object in a space-saving way. However, the detection of a temperature by the image forming apparatus, in which the thermopile arrays are arranged obliquely, has a problem whereas detection accuracy for a temperature of a central region of the detection object is lower than that of the other regions.

Japanese Published Patent Application No. 2009-98361 discloses an image forming apparatus, in which a contactless thermistor is arranged at the central region of the detection object. In the image forming apparatus disclosed in Japanese Published Patent Application No. 2009-98361, detection by the contactless thermistor and detection by thermopiles correct each other, and detection accuracy for a temperature by the contactless thermistor and the thermopiles is improved.

However, in the image forming apparatus disclosed in Japanese Published Patent Application No. 2009-98361, the temperature detected by the thermistor is corrected only by the temperature measured by the thermopile, and it is not possible to detect the temperature of the detection object by the thermopile array without the thermistor.

SUMMARY OF THE INVENTION

It is a general object of at least one embodiment of the present invention to provide an image forming apparatus that substantially obviates one or more problems caused by the limitations and disadvantages of the related art.

In one embodiment, an image forming apparatus includes a heating element group including a plurality of heating elements arranged in a main scanning direction; a first temperature sensor and a second temperature sensor that detect a temperature of a heating element of the plurality of heating elements; and a correction unit that corrects an output value from the first temperature sensor based on the output value from the first temperature sensor and a distance between the first temperature sensor and the heating element and corrects an output value from the second temperature sensor based on the output value from the second temperature sensor and a distance between the second temperature sensor and the heating element.

According to the embodiments of the present invention, an image forming apparatus is provided that detects the temperature of the detection object by the thermopile array with a high degree of accuracy.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

In the following, embodiments of the present invention will be described with reference to the accompanying drawings.

Figure 1:
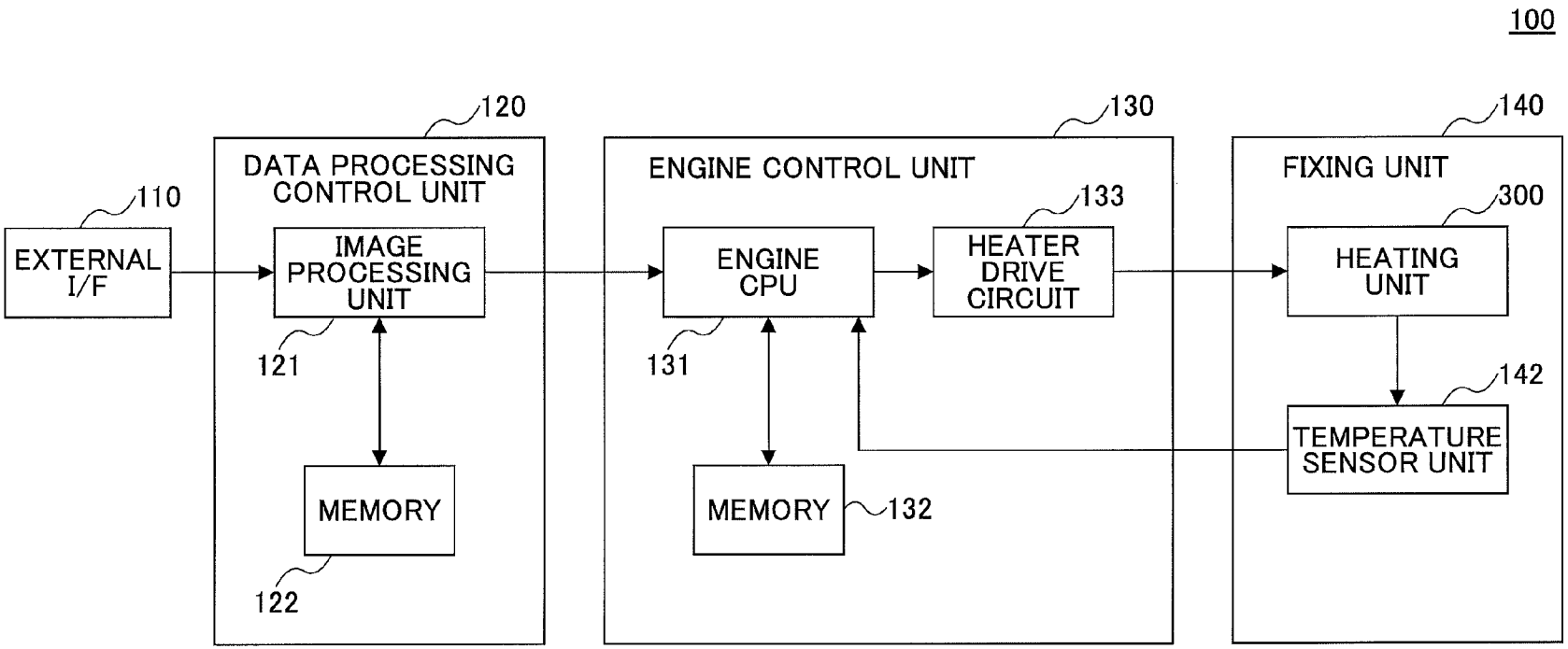
FIG. 1 is a diagram illustrating an example of a configuration of an image forming apparatus according to a present embodiment.

FIG. 1 is a diagram illustrating an example of a configuration of the image forming apparatus according to the present embodiment.

The image forming apparatus 100 according to the present embodiment includes an external I/F (interface) 110, a data processing control unit 120, an engine control unit 130, and a fixing unit 140. The external I/F 110 reads image data from outside. The data processing control unit 120 includes an image processing unit 121 and a memory 122. The image processing unit 121 performs digital processing or the like for the input image data. The memory 122 holds the image data or the like.

The engine control unit 130 includes an engine CPU (central Processing Unit) 131, a memory 132, and a heater drive circuit 133. The engine CPU 131 controls the heater drive circuit 133 based on the image data transmitted from the image processing unit 121. The memory 132 temporarily holds information required for controlling the heater drive circuit 133. The heater drive circuit 133 controls a heating unit in the fixing unit 140.

The fixing unit 140 includes a heating unit 300 and a temperature sensor unit 142. The heating unit 300 according to the present embodiment has a configuration where plural heating elements, such as thermal heads, are arranged in the main scanning direction. The temperature sensor unit 142 detects a temperature of the heating unit 300. More specifically, in the present embodiment, the temperature sensor unit 142 detects a temperature of the heating element included in the heating unit 300, and based on the temperature of the heating element a temperature distribution of the heating unit 300 is obtained.

In the image forming apparatus 100 according to the present embodiment, image data input from the external I/F 110 are stored in the memory 122. The image processing unit 121, based on the image data stored in the memory 122, calculates a position of an image, generates on and off signals for the heating elements and calculate a delay time until heating starts. The image processing unit 121 transmits to the engine CPU 131 information including the on and off signals for the heating elements, the delay time until heating starts, or the like. The engine CPU 131 controls the heater drive circuit 133 based on the information.

Moreover, the temperature sensor unit 142, such as a thermopile, is arranged in the vicinity of the heating unit 300, and monitors the temperature of each of the heating elements. The engine CPU 131 according to the present embodiment performs a feedback control for the heating unit 300 based on the temperatures of the heating elements.

Figure 2:
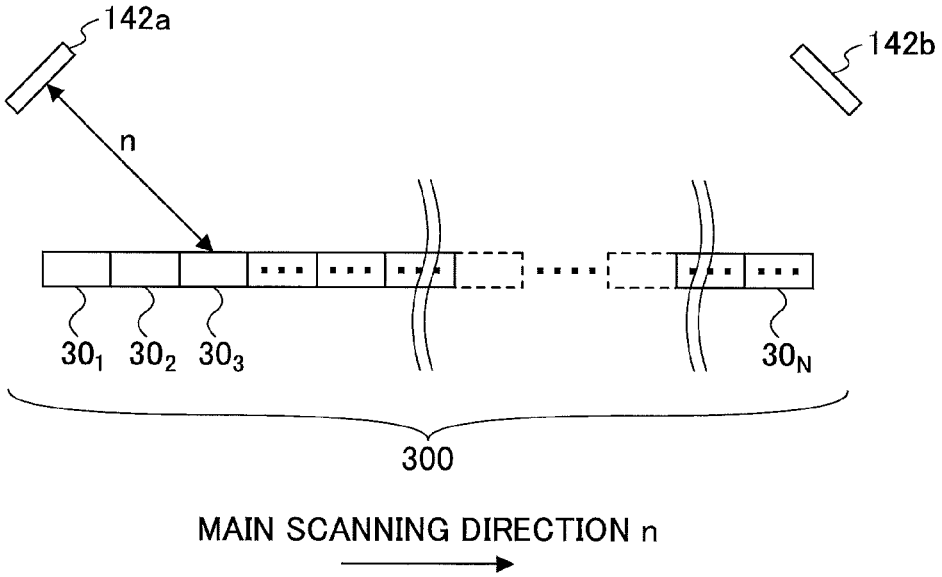
FIG. 2 is an explanatory diagram illustrating an example of an operation of detecting a temperature according to the present embodiment.

The operation of detecting the temperature of the heating unit 300 according to the present embodiment will be explained in the following. FIG. 2 is an explanatory diagram illustrating the operation of detecting the temperature according to the present embodiment.

The heating unit 300 of the fixing unit 140 according to the present embodiment includes a group of heating elements $\mathbf{30}_1$ to $\mathbf{30}_N$, which are arranged in the main scanning direction. If the respective heating elements do not need to be distinguished from each other, they are denoted as "heating element 30" in the following. The temperature sensor unit 142 according to the present embodiment includes temperature sensor elements 142*a* and 142*b*. The temperature sensor elements 142*a* and 142*b* are arranged so as to form acute angles with the heating elements $\mathbf{30}_1$ and $\mathbf{30}_N$ at both ends of the heating unit 300, respectively.

The temperature sensor elements 142*a* and 142*b* are, for example, thermopiles (infrared sensors). Detection accuracy of each of the temperature sensor elements 142*a* and 142*b* varies with a distance to a detection object, a temperature of which is detected. More specifically, the detection accuracy of each of the temperature sensor elements 142*a* and 142*b* decreases as the distance to the detection object increases. Output value V from each of the temperature sensor elements 142*a* and 142*b* is indicated by Formula 1 as follows:

$$V=k/n^2 \qquad \text{Formula 1}$$

where k is a constant and n is a distance between the detection object and the temperature sensor element 142. In the present embodiment, the detection object is the heating element included in the heating unit 300. In the present embodiment, the distance n is a distance between a midpoint of the temperature sensor element 142*a* or 142*b* and the detection object.

Figure 3:
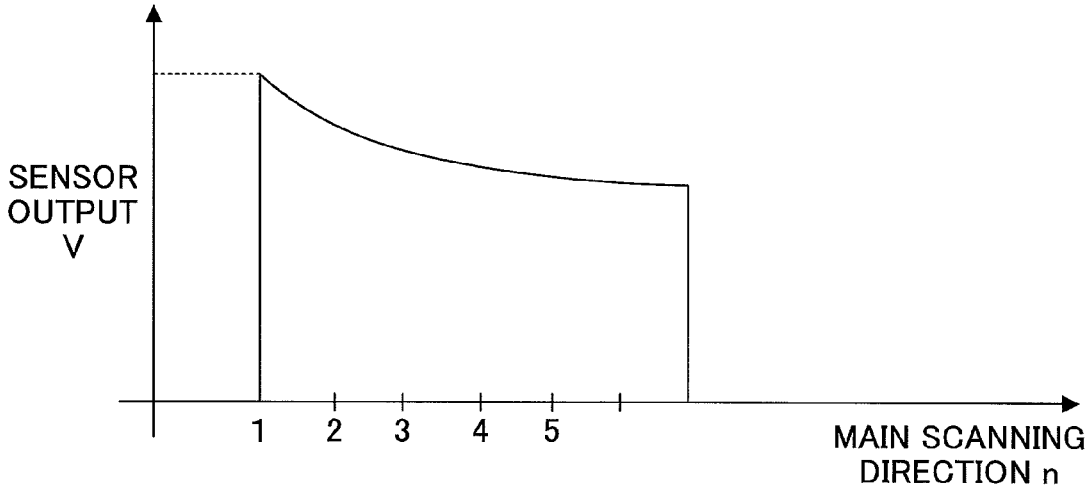
FIG. 3 is a diagram illustrating an example of an output value from a temperature sensor in the case of uniform distribution of temperature according to the present embodiment.

FIG. 3 is a diagram illustrating the output value from the temperature sensor unit in the case of uniform distribution of temperature of the heating unit. In FIG. 3, the ordinate axis shows the output value from the temperature sensor element 142*a* or 142*b*, and the abscissa axis shows the distance in the main scanning direction. Since the characteristics of the temperature sensor elements 142*a* and 142*b* are the same, the relationship between the output value and the distance, shown in FIG. 3 can be applied to both of the temperature sensor elements 142*a* and 142*b*.

As can be seen from FIG. 3, the detection accuracy becomes higher as the distance between the temperature sensor element 142*a* or 142*b* and the detection object decreases.

In the case where the temperature sensor elements 142*a* and 142*b* are arranged as shown in FIG. 2, the heating element 30 arranged in the central region of the heating unit 300 is far from any of the temperature sensor elements 142*a* and 142*b*. Accordingly, for example, even when the temperature distribution is uniform for the heating elements $\mathbf{30}_1$ to $\mathbf{30}_N$, the output value from the temperature sensor element 142*a* or 142*b* for the heating element at the end of the heating unit 300 may be different from the output value for the heating element in the central region of the heating unit 300.

In the present embodiment, the output from the temperature sensor elements 142*a* and 142*b* are corrected, and thereby the detection accuracy in the temperature of the heating unit 300 is improved. Specifically, in the present embodiment, the output from the temperature sensor elements 142*a* and 142*b* are corrected by the engine CPU 131 in the engine control unit 130.

Figure 4:
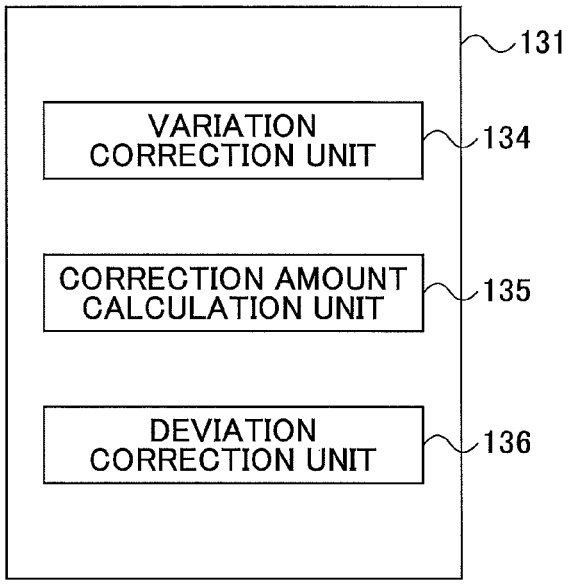
FIG. 4 is a diagram illustrating an example of a functional configuration of an engine CPU (Central Processing Unit) according to the present embodiment.

FIG. 4 is a diagram illustrating the functional configuration of the engine CPU 131.

The engine CPU 131 according to the present embodiment includes a variation correction unit 134, a correction amount calculation unit 135 and a deviation correction unit 136.

The variation correction unit 134 according to the present embodiment, corrects the variation for the temperature sensor elements 142*a* and 142*b*, in a state where all the heating elements in the heating unit 300 are heated to the same temperature. The state where all the heating elements are heated to the same temperature is, for example, a state just after the power of the image forming apparatus 100 is turned on, a state when an entire region is heated by the heating unit 300, or the like.

The correction amount calculation unit 135 according to the present embodiment calculates a difference between a true temperature and the output value from the temperature sensor element. The true temperature is a target temperature for each of the heating elements, which corresponds to a target temperature for the heating unit 300 set in the heater drive circuit 133 by the engine CPU 131.

The deviation correction unit 136 according to the present embodiment corrects, when a recording paper is fed through the fixing unit 140, a deviation in the output value depending on the distance between the temperature sensor element 142*a* or 142*b* and the heating element, which is the detection object.

Figure 5A:
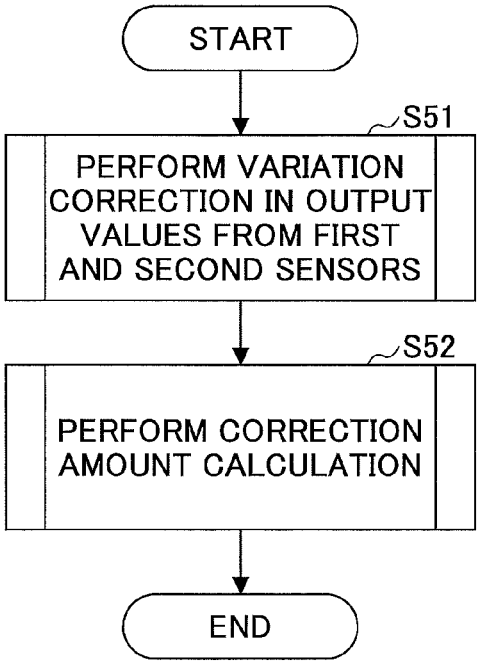
FIGS. 5A and 5B are flowcharts illustrating operations of the engine CPU according to the present embodiment.
Figure 5B:
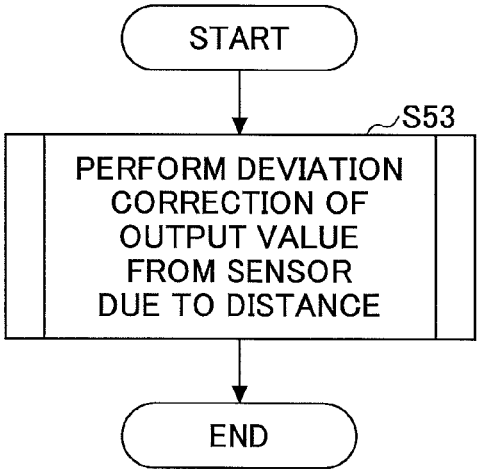

The operation of the engine CPU 131 according to the present embodiment will be described in the following. FIGS. 5A and 5B are flowcharts illustrating the operation of the engine CPU 131. FIG. 5A illustrates the operation just after the power of the image forming apparatus 100 is turned on, or after the heating of the entire region, i.e. all the heating element are heated. FIG. 5B illustrates the operation when a recording paper is fed through the fixing unit 140.

The engine CPU 131 according to the present embodiment, when the power of the image forming apparatus 100 is turned on, for example, performs the operation of correcting the variation for the temperature sensor elements 142*a* and 142*b* by the variation correction unit 134 (step S51). Then, the engine CPU 131 performs the operation of calculating the correction amount by the correction amount calculation unit 135 (step S52).

Moreover, when feeding of the recording paper is detected, the engine CPU 131 according to the present embodiment performs the operation of correcting the deviation in the output value from the temperature sensor element 142*a* or 142*b* depending on the distance between the temperature sensor element 142*a* or 142*b* and the heating element (step S53). Operations of respective steps in FIGS. 5A and 5B will be explained in detail later.

With reference to FIGS. 6A, 6B, 7 and 8, the operation of correcting the variation for the temperature sensor elements 142*a* and 142*b* by the variation correction unit 134 according to the present embodiment will be explained in the following.

Figure 6A:
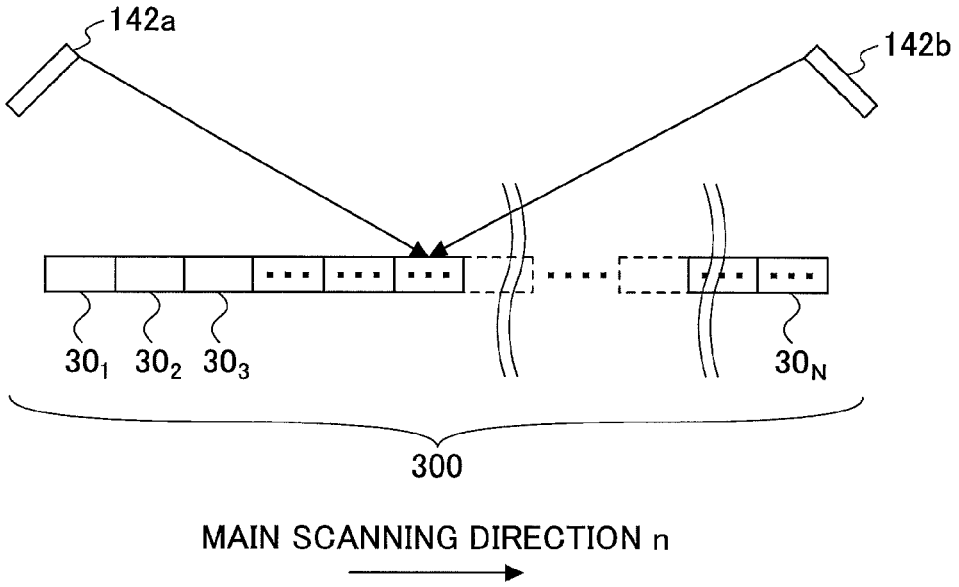
FIGS. 6A and 6B are diagrams illustrating an example of a variation of temperature detected by the temperature sensor according to the present embodiment.
Figure 6B:
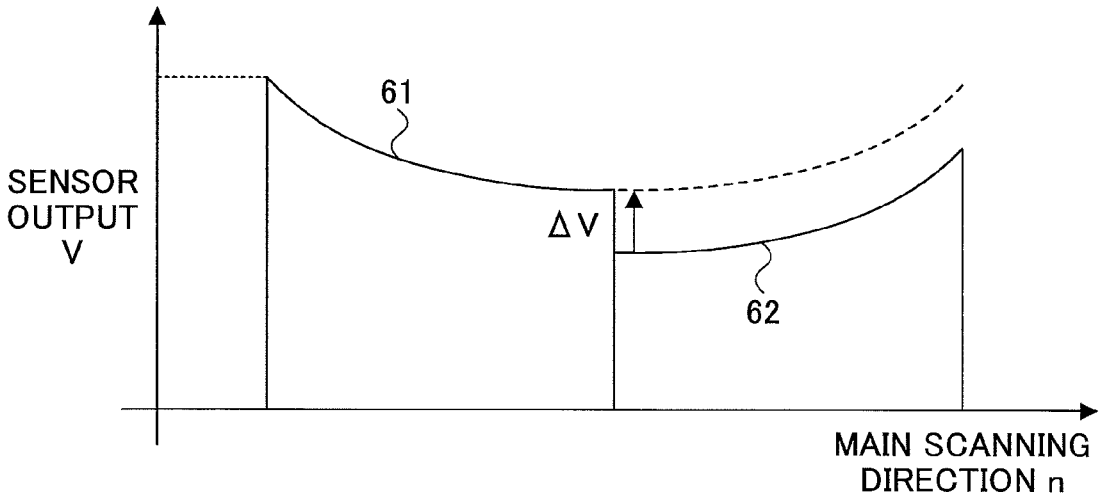

FIGS. 6A and 6B are diagrams illustrating the variation of temperature detected by the temperature sensor.

In the present embodiment, surface temperatures of the heating element 30 arranged in the central region of the heating unit 300, which can be detected by both the temperature sensor elements 142*a* and 142*b*, are detected, and a difference ΔV between the output values from the temperature sensor elements is added to either of the output values.

Curves 61 and 62 in FIG. 6B indicate the output values from the temperature sensor elements 142*a* and 142*b*, respectively. In the variation correction unit 134 according to the present embodiment, the difference ΔV between the output values from the temperature sensor elements 142*a* and 142*b* is added to the output value from the temperature sensor element 142*b*.

Figure 7:
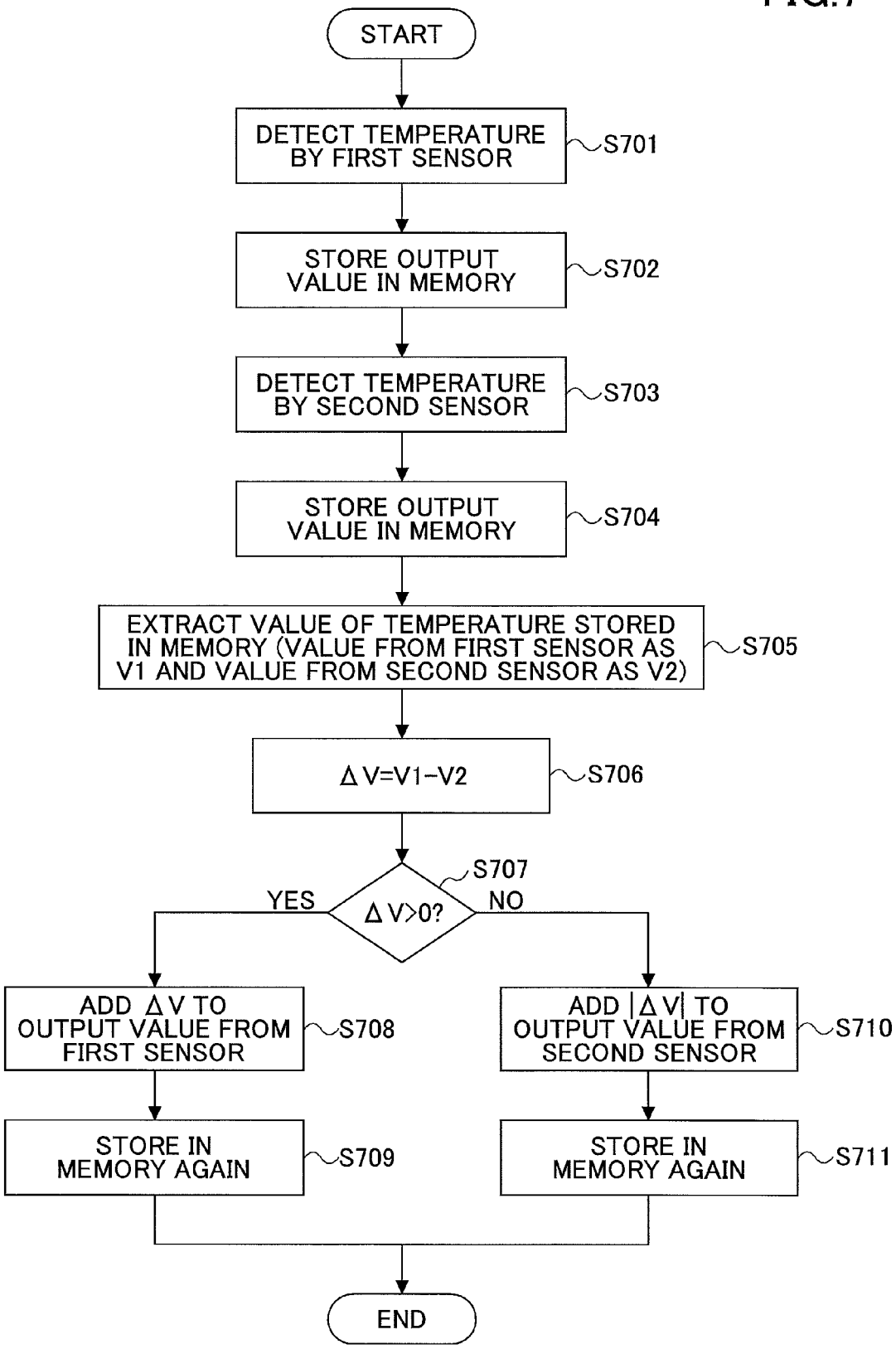
FIG. 7 is a flowchart illustrating an example of an operation of a variation correction unit according to the present embodiment.

FIG. 7 is a flowchart illustrating an example of an operation of the variation correction. In the following explanation, the temperature sensor elements 142*a* and 142*b* will be referred to first and second temperature sensors, respectively.

The variation correction unit 134 according to the present embodiment detects the temperature of the heating element 30 by the first sensor (step S701), and stores the output value from the first sensor in the memory 132 (step S702). Next, the variation correction unit 134 detects the temperature for the heating element 30 by the second sensor (step S703), and stores the output value from the second sensor in the memory 132 (step S703). The temperatures detected at steps S701 and S703 are the surface temperatures of the heating element 30 arranged in the central region of the heating unit 300, which can be detected by the first and second sensors, respectively.

Next, the variation correction unit 134 extracts the values of the temperature stored in the memory 132 (step S705). Here, the output values from the first and second sensors are denoted V1 and V2, respectively.

The variation correction unit 134 calculates a difference ΔV between the output values V1 and V2 (step S706). Here, the difference ΔV is obtained by subtracting the output value V2 from the output value V1, i.e. ΔV=V1−V2.

Next, the variation correction unit 134 determines whether the difference ΔV is positive or not (step S707). When the difference is positive (step S707 YES), i.e. ΔV>0, the variation correction unit 134 adds the difference ΔV to the output value from the first sensor (step S708). The variation correction unit 134, then, stores the added value in the memory 132 (step S709), and the process ends.

Moreover, when the difference ΔV is negative or zero (step S707 NO), the variation correction unit 134 adds an absolute value of ΔV, i.e. |ΔV|, to the output value from the second sensor (step S710). The variation correction unit 134, then, stores the added value in the memory 132 (step S711), and the process ends.

Figure 8:
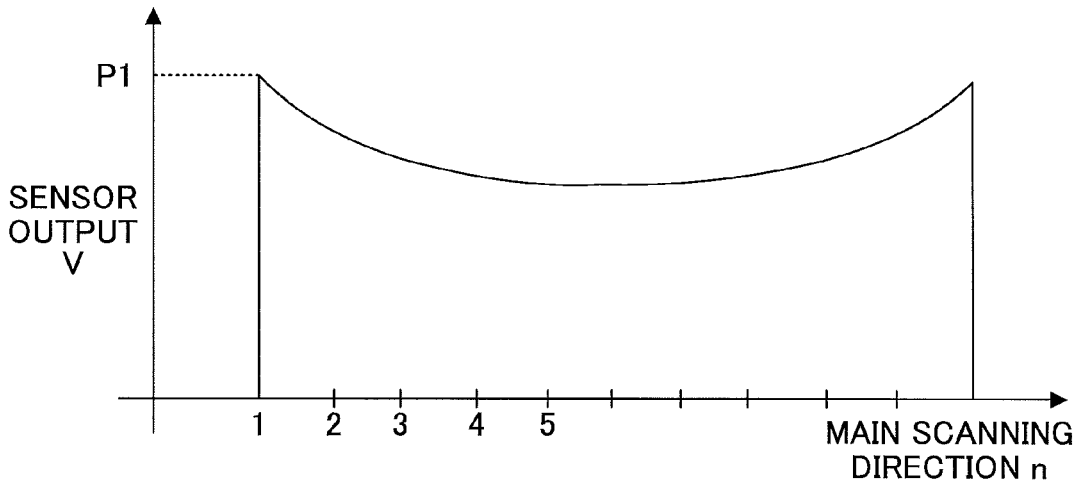
FIG. 8 is a diagram illustrating an example of output value from the temperature sensor after the variation correction according to the present embodiment.

FIG. 8 is a diagram illustrating an example of the output value from the temperature sensor after the variation correction.

As shown in FIG. 8, after the variation correction, a difference ΔV between the output values from the temperature sensor element 142*a* (the first sensor) and the temperature sensor element 142*b* (the second sensor) is no longer present.

Figure 9:
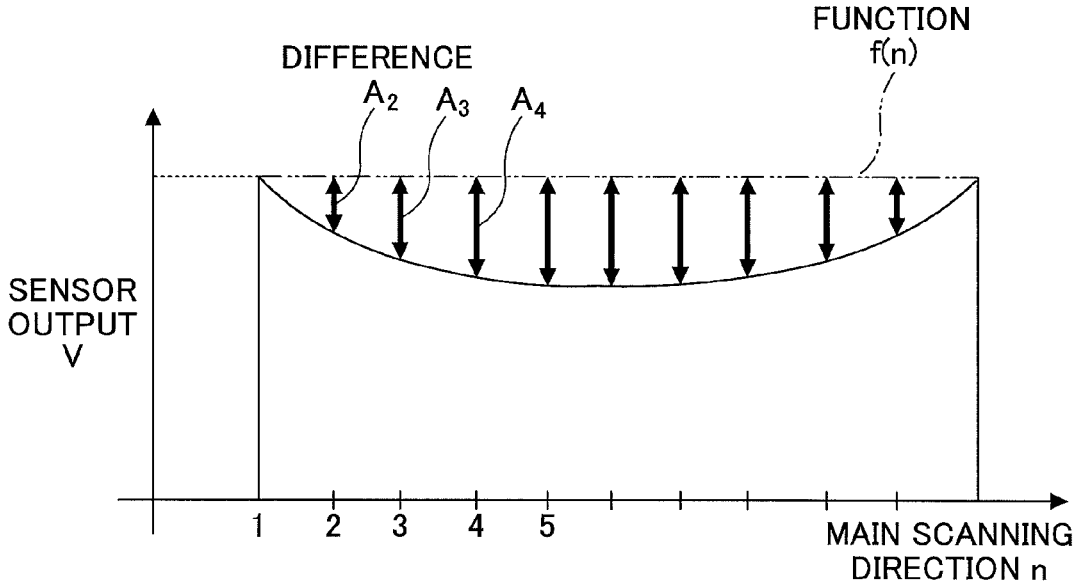
FIG. 9 is an explanatory diagram illustrating an example of operation of calculating a correction amount according to the present embodiment.

Next, the process of the correction amount calculation unit 135 according to the present embodiment will be explained. FIG. 9 is an explanatory diagram illustrating the process of calculating a correction amount.

The correction amount calculation unit 135 according to the present embodiment calculates an amount of deviation in order to correct a difference (deviation) between the true temperature and the output value from the temperature sensor element 142*a* or 142*b* due to the distance from the temperature sensor element 142*a* or 142*b* to the detection object.

The procedure of calculating the amount of the deviation will be described in the following. A temperature of the heating element $\mathbf{30}_n$, detected by the temperature sensor element 142*a* or 142*b* and after the variation correction, is denoted $P_n$, where n is an index to the heating element in the main scanning direction.

In the present embodiment, a linear function f(n) is derived based on the temperatures of the heating elements 301 and 30N, which are located at both ends of the heating unit 300. A value of the linear function f(n) according to the present embodiment at n represents a target temperature for the heating element 30*n*. As shown in FIG. 9, the heating element closest to the temperature sensor element 142*a* or 142*b* is the heating heating element located at either of the ends of the heating unit 300. Specifically, the heating element 301 is closest to the temperature sensor element 142*a*, and the heating element 30N is closest to the temperature sensor element 142*b*. In the present embodiment, the output value of the temperature of the heating element 301 detected by the temperature sensor element 142*a* is denoted P1, and the output value of the temperature of the heating element 30N detected by the temperature sensor element 142*b* is denoted PN. The linear function f(n) is given by the following Formula 2.

$$f(n)=(P_1-P_N)/N\times n+P_N \qquad \text{Formula 2}$$

where N is the total number of the heating elements. The output value $P_1$ is the maximum value of output values from the temperature sensor element 142*a*, and the output value $P_N$ is the maximum value of output values from the temperature sensor element 142*b*.

The linear function f(n) is not limited to the function shown by Formula 2. The linear function f(n) may be expressed by either of the following formulas.

$$f(n)=(P_N-P_1)/N\times n+P_1 \qquad \text{Formula 2-1}$$

$$f(n)=(P_1+P_N)/2. \qquad \text{Formula 2-2}$$

Next, a difference (correction amount) between the true temperature of the heating element $\mathbf{30}_n$ and the output value from the temperature sensor element 142*a* or 142*b* due to the distance from the temperature sensor element 142*a* or 142*b* to the detection object is denoted $A_n$. The correction amount $A_n$ is expressed by the following Formula 3 using the value of the linear function f(n) at n and the detected value of the temperature $P_n$ of the heating element $\mathbf{30}_n$ after the variation correction.

$$A_n=f(n)-P_n. \qquad \text{Formula 3}$$

In the present embodiment, $A_n$ is calculated as the amount of the deviation.

Figure 10:
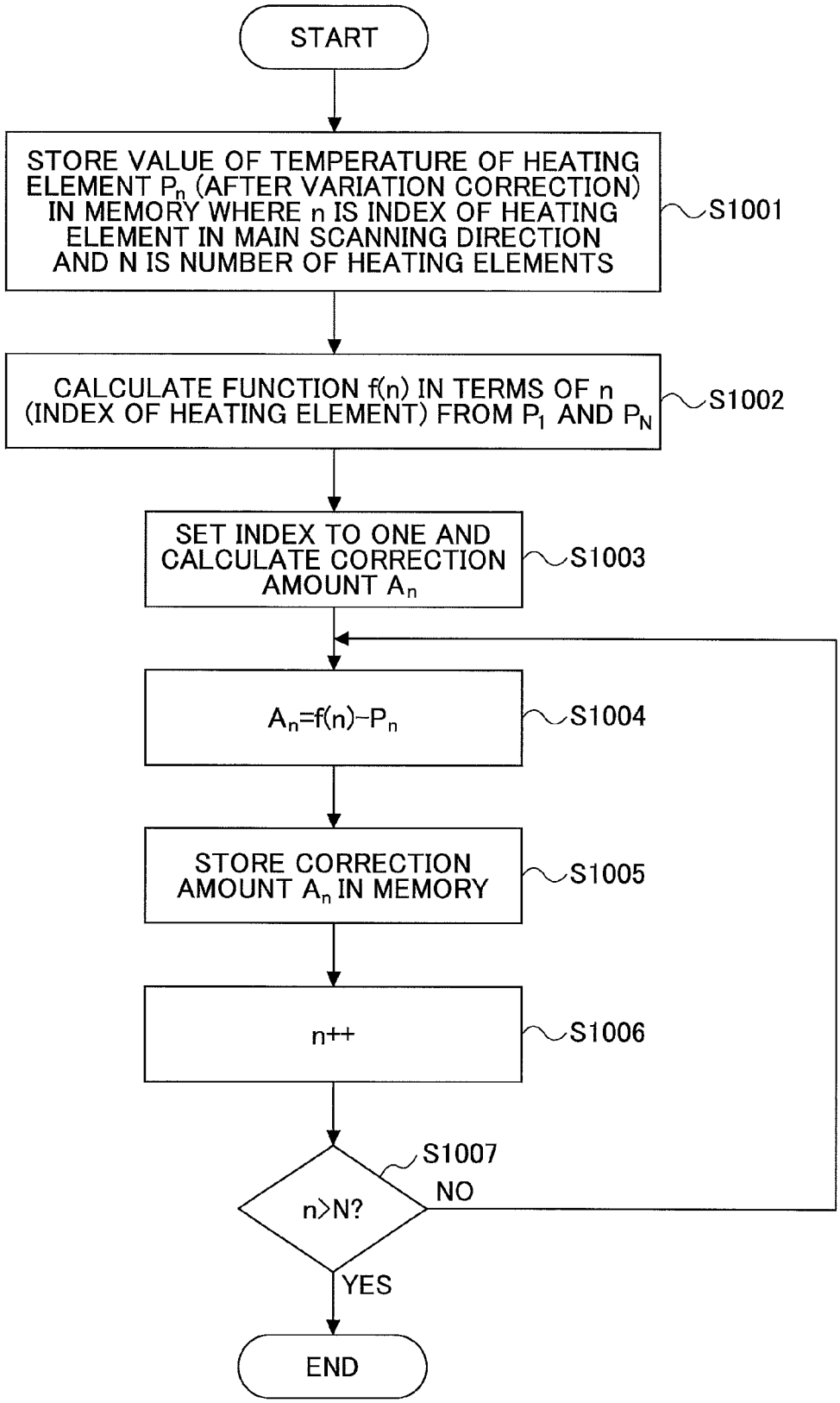
FIG. 10 is a flowchart illustrating an example of an operation of a correction amount calculation unit according to the present embodiment.

FIG. 10 is a flowchart illustrating the operation of the correction amount calculation unit 135.

The correction amount calculation unit 135 according to the present embodiment stores values of the temperatures of heating elements $P_n$ in the memory 132 (step S1001). The temperatures of the heating elements, mentioned here, are the temperatures after the variation correction.

The correction amount calculation unit 135 derives the linear function f(n) by using the output value $P_1$ from the temperature sensor element 142*a* and the output value $P_N$ from the temperature sensor element 142*b* (step S1002). Then, the correction amount calculation unit 135 sets the index of the heating element in the main scanning direction to one, i.e. n=1 (step S1003). Next, the correction amount calculation unit 135 calculate the correction amount $A_n$ according to Formula 3 (step S1004), and stores the correction amount $A_n$ to the memory 132 (step S1005).

The detection object by the temperature sensor element 142*a* or 142*b* proceeds to the next heating element by the correction amount calculation unit 135 (step S1006). That is, the index n is incremented by one.

Next, the correction amount calculation unit 135 determines whether the correction amounts are calculated for all the heating elements or not (step S1007). When a heating element, for which a correction amount has not been calculated, remains, the process of the correction amount calculation unit 135 returns to step S1004. When the correction amounts for all the heating elements have been calculated, the process of the correction amount calculation unit 135 ends.

Next, the process of the deviation correction unit 136 will be described. In the following, with reference to FIG. 11, the process of correcting deviation of the output value from the temperature sensor element 142*a* or 142*b* due to the distance between the temperature sensor element 142*a* or 142*b* and the heating element will be explained.

Figure 11:
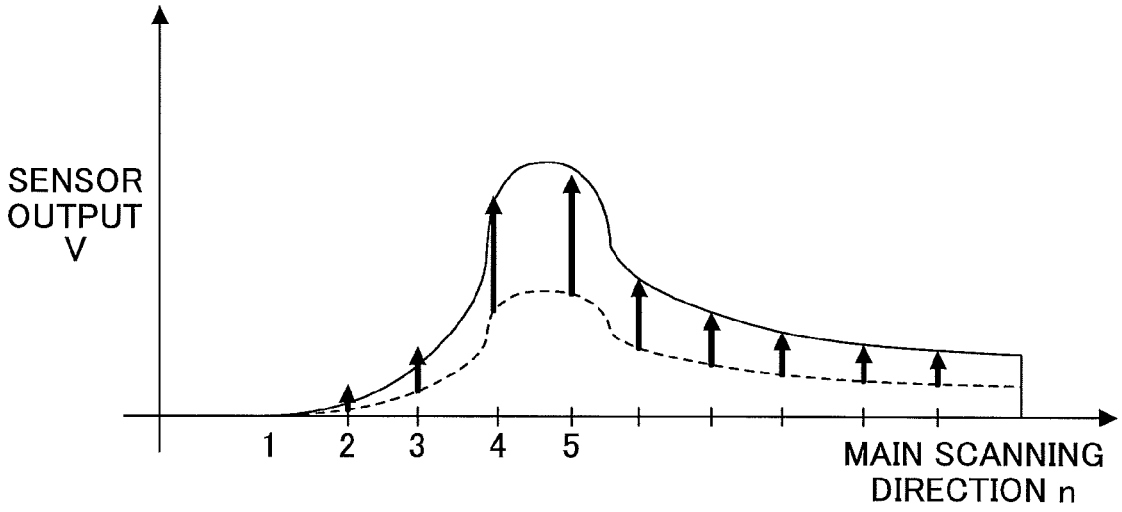
FIG. 11 is an explanatory diagram illustrating an example of operation of correcting a deviation in the output value from the temperature sensor according to the present embodiment.

FIG. 11 is a diagram illustrating the operation of correcting the deviation of the output value from the temperature sensor. The deviation correction unit 136 according to the present embodiment, with reference to the correction amount, which is calculated just after the power of the image forming apparatus 100 is turned on or when the entire region is heated by the heating unit 300, corrects the deviation of the output value due to the distance between the temperature sensor element 142*a* or 142*b* an the heating element, when a recording paper passes through the fixing unit 140.

In the present embodiment, the output value from the temperature sensor element 142*a* or 142*b* obtained on feeding the recording paper through the fixing unit 140 is denoted $S'_n$, and the output value after the deviation correction for the output value due to the distance between the temperature sensor element 142*a* or 142*b* and the heating element, as the detection object, is denoted $P'_n$. The output value after the correction is expressed by the following Formula 4.

$$P'_n = S'_n + A_n. \qquad \text{Formula 4}$$

Figure 12:
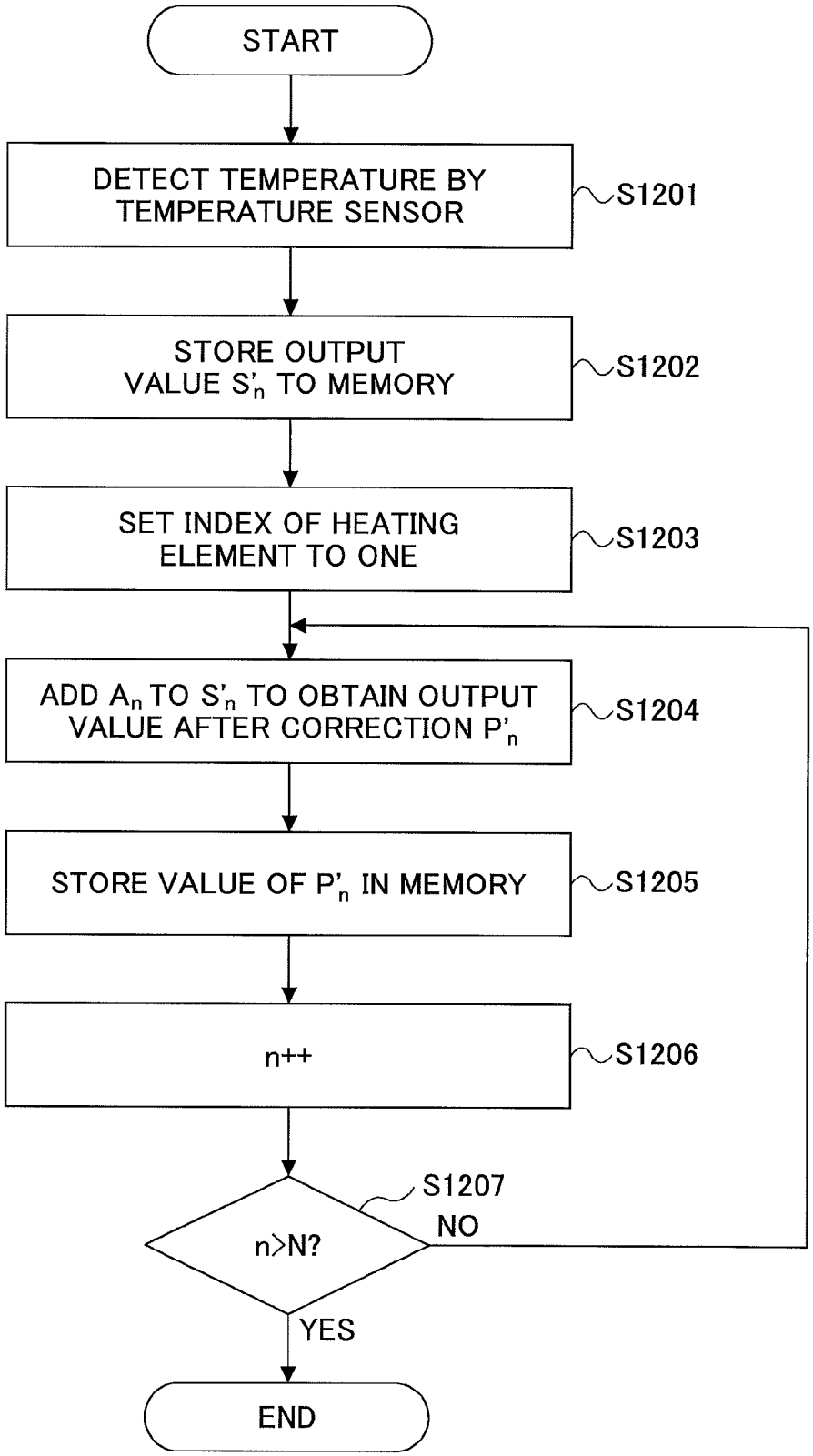
FIG. 12 is a flowchart illustrating an example of an operation of the deviation correction unit according to the present embodiment.

In the present embodiment, the deviation of the output value from the temperature sensor element 142*a* or 142*b* on feeding the recording paper through the fixing unit 140 is corrected, as above. FIG. 12 is a flowchart illustrating the operation of the deviation correction unit.

The deviation correction unit 136 according to the present embodiment detects temperatures of respective heating elements by the temperature sensor elements 142*a* and 142*b* (step S1201), and stores the output value $S'_n$ from the temperature sensor element 142*a* or 142*b* to the memory 132 (step S1202). The deviation correction unit 136, then, sets the index n of the heating element in the main scanning direction to one, i.e. n=1 (step S1203).

Next, the deviation correction unit 136 calculates the output value after the correction $P'_n$ by using the output value from the temperature sensor element 142*a* or 142*b* $S'_n$ stored in the memory 132 and the correction amount $A_n$ (step S1204). The output value after the correction $P'_n$ is the output value from the temperature sensor element 142*a* or 142*b* after the correction. The deviation correction unit 136 stores the output value after the correction $P'_n$ in the memory 132 (step S1205).

Next, the detection object by the temperature sensor element 142*a* or 142*b* proceeds to the next heating element by the deviation correction unit 136 (step S1206). That is, the index n is incremented by one.

The deviation correction unit 136 determines whether the output values are corrected for all the heating elements (step S1207). When a heating element remains, for which the output value has not been corrected, the process or the deviation correction unit 136 returns to step S1204. When the output values for all the heating elements have been corrected, the process of the deviation correction unit 136 ends.

As described above, in the present embodiment, without using a contactless thermistor or the like, the temperatures of respective heating elements of the heating unit 300 can be detected with high accuracy by two temperature sensor elements provided in the vicinity of both the ends of the heating unit 300, respectively.

Further, the present invention is not limited to these embodiments, but various variations and modifications may be made without departing from the scope of the present invention.

The present application is based on and claims the benefit of priorities of Japanese Priority Applications No. 2013-026446 filed on Feb. 14, 2013, and No. 2013-265732 filed on Dec. 24, 2013 with the Japanese Patent Office, the entire contents of which are hereby incorporated by reference.

What is claimed is:

1. An image forming apparatus, comprising:

a heating element group including a plurality of heating elements arranged in a main scanning direction;

a first temperature sensor and a second temperature sensor to detect a temperature of a heating element of the plurality of heating elements; and a correction unit to correct an output value from the first temperature sensor based on the output value from the first temperature sensor and a distance between the first temperature sensor and the heating element and to correct an output value from the second temperature sensor based on the output value from the second temperature sensor and a distance between the second temperature sensor and the heating element, wherein the correction unit includes a variation correction unit to perform a variation correction in the output values from the first temperature sensor and the second temperature sensor by using an output from the first temperature sensor and an output from the second temperature sensor when all of the plurality of heating elements are in a uniform temperature.

2. The image forming apparatus as claimed in claim 1, wherein the correction unit includes a deviation amount calculation unit to calculate a deviation amount of the output values of the first temperature sensor and of the second temperature sensor from a target temperature of the heating element, which has been set previously, by using a maximum value of the output value from the first temperature sensor and a maximum value of the output value from the second temperature sensor, when the temperature of the heating element is detected by the first temperature sensor and the second temperature sensor.

3. The image forming apparatus as claimed in claim 2, wherein the correction unit includes a deviation correction unit to correct a deviation amount of the output value from the first temperature sensor according to the distance between the heating element and the first temperature sensor and to correct a deviation amount of the output value from the second temperature sensor according to the distance between the heating element and the second temperature sensor.

4. The image forming apparatus as claimed in claim 3, wherein the deviation amount calculation unit is configured to calculate the deviation amount based on a linear function calculated from the maximum value of the output value from the first temperature sensor and the maximum value of the output value from the second temperature sensor and on the output values from the first temperature sensor and from the second temperature sensor after the variation correction by the variation correction unit, and wherein the deviation correction unit is configured to correct a deviation of the output value from the first temperature sensor due to the distance between the first temperature sensor and the heating element based on the output value from the first temperature sensor after the variation correction and the calculated deviation amount, and is configured to correct a deviation of the output value from the second temperature sensor due to the distance between the second temperature sensor and the heating element based on the output value from the second temperature sensor after the variation correction and the calculated deviation amount.

5. The image forming apparatus as claimed in claim 1, wherein the correction unit includes a deviation correction unit to correct a deviation amount of the output value from the first temperature sensor according to the distance between the heating element and the first temperature sensor and to correct a deviation amount of the output value from the second temperature sensor according to the distance between the heating element and the second temperature sensor.

6. An image forming apparatus, comprising:

a heating element group including a plurality of heating elements arranged in a main scanning direction;

a first temperature sensor and a second temperature sensor to detect a temperature of a heating element of the plurality of heating elements; and a correction unit to correct an output value from the first temperature sensor based on the output value from the first temperature sensor and a distance between the first temperature sensor and the heating element and to correct an output value from the second temperature sensor based on the output value from the second temperature sensor and a distance between the second temperature sensor and the heating element, wherein the correction unit includes a deviation amount calculation unit to calculate a deviation amount of the output values of the first temperature sensor and of the second temperature sensor from a target temperature of the heating element, which has been set previously, by using a maximum value of the output value from the first temperature sensor and a maximum value of the output value from the second temperature sensor, when the temperature of the heating element is detected by the first temperature sensor and the second temperature sensor.

7. The image forming apparatus as claimed in claim 6, wherein the correction unit includes a deviation correction unit to correct a deviation amount of the output value from the first temperature sensor according to the distance between the heating element and the first temperature sensor and to correct a deviation amount of the output value from the second temperature sensor according to the distance between the heating element and the second temperature sensor.

8. The image forming apparatus as claimed in claim 7, wherein the deviation amount calculation unit is configured to calculate the deviation amount based on a linear function calculated from the maximum value of the output value from the first temperature sensor and the maximum value of the output value from the second temperature sensor and on the output values from the first temperature sensor and from the second temperature sensor after the variation correction by the variation correction unit, and wherein the deviation correction unit is configured to correct a deviation of the output value from the first temperature sensor due to the distance between the first temperature sensor and the heating element based on the output value from the first temperature sensor after the variation correction and the calculated deviation amount, and is configured to correct a deviation of the output value from the second temperature sensor due to the distance between the second temperature sensor and the heating element based on the output value from the second temperature sensor after the variation correction and the calculated deviation amount.

* * * * *